US005826156A

United States Patent [19]

Natsume et al.

[11] Patent Number: 5,826,156

[45] Date of Patent: Oct. 20, 1998

[54] IMAGE FORMING APPARATUS

[75] Inventors: Junko Natsume, Aichi-Ken; Kazuhiro Araki, Okazaki, both of Japan

[73] Assignee: Minolta Co., Ltd., Osaka, Japan

[21] Appl. No.: 810,976

[22] Filed: Feb. 27, 1997

[30] Foreign Application Priority Data

| | | | |
|---|---|---|---|
| Feb. 28, 1996 | [JP] | Japan | 8-041069 |
| Feb. 28, 1996 | [JP] | Japan | 8-041072 |
| Feb. 28, 1996 | [JP] | Japan | 8-041073 |

[51] Int. Cl.[6] ..... G03G 15/00

[52] U.S. Cl. ..... 399/389; 271/171; 271/258.01; 271/258.04; 399/391; 399/392

[58] Field of Search ..... 399/389, 391, 399/392, 393, 370, 371, 81; 271/171, 258.01, 258.04, 259

[56] References Cited

U.S. PATENT DOCUMENTS

| | | | |
|---|---|---|---|
| 4,008,957 | 2/1977 | Summers | 399/23 |
| 4,607,945 | 8/1986 | Ide et al. | 399/209 |
| 4,780,740 | 10/1988 | Fukae | 399/86 |
| 4,908,673 | 3/1990 | Muramatsu . | |
| 4,933,720 | 6/1990 | Takano et al. | 399/389 |
| 4,969,008 | 11/1990 | Muramatsu . | |
| 5,065,198 | 11/1991 | Yamashita et al. | 399/86 |
| 5,110,106 | 5/1992 | Matsumura et al. | 271/171 X |
| 5,159,387 | 10/1992 | Takahashi et al. . | |
| 5,332,208 | 7/1994 | Tsuji et al. | 271/171 |
| 5,390,005 | 2/1995 | Kimoto et al. | 399/81 |
| 5,611,528 | 3/1997 | Nakamura et al. | 271/171 X |

*Primary Examiner*—Matthew S. Smith
*Attorney, Agent, or Firm*—Burns, Doane, Swecker & Mathis, LLP

[57] ABSTRACT

The size of a paper put in a tray for manual insertion is decided according to detectors provided in the tray. When detection precision of the paper size is not so high to determine paper size, it is instructed to specify a paper size manually. In another example, a paper size selection picture including a plurality of paper sizes is displayed in a touch panel for assisting an operator to select paper size manually. Thus, paper size for the tray can be specified manually, and erroneous copying can be prevented. In situations where paper size is not needed to update, paper size selection is not instructed.

21 Claims, 13 Drawing Sheets

S105
Input
S401
Size select mode ?
NO
RETURN
YES
S402
Is there a paper on the tray ?
NO
S404
Display all size selection picture
S403
YES
Size selection picture
S405
Is size key touched ?
NO
S408
Is 10-key pressed ?
NO
YES
S406
Determine a size
S409
YES
Set 10-key input mode
S407
Display the size
RETURN
S410
10-key input mode ?
NO
YES
S411
Set 10-key input mode
S412
Determine a size
S413
Display the size
S414
Reset 10-key input mode
RETURN

Fig. 14

SELECT THE SIZE
OF INSERTED PAPER.

205

| | | |
|---|---|---|
| | | 11×14 |
| | | 11×15 |
| | | 11×17 |
| | | |
| | | |
| | | |

Fig. 15

SELECT THE SIZE
OF INSERTED PAPER.

205

| | | |
|---|---|---|
| | | |
| A4T | 8.5×11T | |
| | | |
| | 8.5×14T | FLS |
| | | |
| | | |

*Fig. 16A*

SELECT THE SIZE OF INSERTED PAPER.

| | | |
|---|---|---|
| A3T | B5Y | 11X14 |
| A4T | 8.5X11T | 11X15 |
| A4T | 8.5X11Y | 11X17 |
| A5T | 8.5X14T | FLS |
| B4T | 5.5X8.5T | 10-key input |
| B5T | 5.5X8.5Y | |

205

*Fig. 16B*

PAPER SELECT

AUTO SELECT

PAPER FEED CASSETTE 1

PAPER FEED CASSETTE 2

TRAY FOR INSERTION

205

*Fig. 17*

PAPER SELECT

AUTO SELECT

PAPER SUPPLY CASSETTE 1

PAPER SUPPLY CASSETTE 2

TRAY FOR INSERTION A4T

205

IMAGE FORMING APPARATUS

BACKGROUND OF THE INVENTION

1. Field of the Invention

The present invention relates to an image forming apparatus such as a copying machine having a paper supplier with a tray for manual insertion.

2. Description of Related Art

An image forming apparatus such as a copying machine has paper cassettes for supplying papers of predetermined sizes. Further, it also has a paper supplier which supplies papers put on a tray for manual insertion. The size of the paper put on the tray may, and it can be detected with sensors arranged along the paper supply direction and along another direction perpendicular to the paper supply direction. Usually, a paper has is one of standard paper sizes such as A4, and the paper size can be determined with a relatively small number of sensors. A document image can be enlarged or reduced according to the detected paper size.

The paper size can be detected more surely by setting many sensors in the tray. However, it is difficult to set many sensors in the tray because the tray is folded to the main body of the apparatus when not used. The mechanism of the tray also makes it inconvenient to set many sensors in the tray. For example, if the size of the paper is small, the tray is sometimes used without being extended fully. Then, it is difficult to detect the paper size correctly even if many sensors are set. Therefore, the size of a paper put on the tray cannot be detected surely by the sensors. For example, when a paper of letter size (8.5 inches or 126 mm long) having about the same width of A4 size (120 mm long) is put on the tray, the paper size cannot be discriminated from each other, and this causes an erroneous operation to produce copies having an incomplete image or the like. If the size of a paper put on the tray cannot be determined on the bases of the sensors, it is needed for an operator to specify it with an operational panel. However, it is inconvenient for an operator to specify the paper size whenever a paper is put on the tray.

SUMMARY

An object of the present invention is to provide an image forming apparatus which can specify a correct paper size for the tray for manual insertion.

Another object of the present invention is to provide an image forming apparatus which need not specify a paper size by an operator when it is not necessary to specify a paper size for the tray for manual insertion.

In one aspect of an image forming apparatus of the invention, a paper supplier is provided to insert a paper manually. A detector detects at least a length of one side of the paper supplied to the paper supplier, and a specifying means specifies a paper size of the paper according to signals received from the detector. The paper supplier comprises a guide member for guiding the paper, and the detector has a sensor to detect the paper size along the direction perpendicular to the paper supply direction according to a position of the guide member. Preferably, the detector further comprises a second sensor for detecting whether a length of the paper along the paper supply direction is longer than a predetermined length or not. When a paper size of the paper put in the paper supplier is not specified, an operator is requested to specify the paper size manually with an input device, for example, by referring to paper sizes displayed in a liquid crystal panel derived from signals received from the detector.

In another aspect of the invention, a paper supplier for inserting a paper manually is provided, and a detector detects at least a length of one side of a sheet of paper supplied to the paper supplier. When a paper size of the paper cannot be determined by the detector, a plurality of paper sizes satisfying a predetermined criteria according to the result of the detector is displayed for assisting an operator for selecting the paper size. For example, paper sizes having a side equal to the length detected by the detector are detected. In a different example, paper sizes having a side within a predetermined range including the length detected by the detector are displayed. Then, an operator can specify a paper size easily by referring the displayed paper sizes.

In a further aspect of the invention, a paper supplier is provided for inserting a paper manually, and a first detector detects a length of at least one side of a sheet of paper supplied to the paper supplier. A second instruction means inputs a paper size manually when a paper in the paper supplier is not detected and paper supply by the paper supplier is instructed.

In a different aspect of the invention, in an image forming apparatus, a paper supplier is not needed to have sensors for detecting a paper size. When a sheet of paper put in the paper supplier is detected, manual input of a paper size is instructed if interrupt of image forming is not detected, otherwise a current paper size set before interrupt is kept. In a different example, an image forming apparatus has a paper supplier having no sensors for detecting a paper size. When a sheet of paper in the paper supplier is not specified, manual input of a paper size is instructed if interrupt of image forming is not detected by the first detector, otherwise a current paper size set before the interrupt is kept or the paper size is not updated.

An advantage of the present invention is that the paper size can be specified surely by specifying a paper size manually when the paper size cannot be decided according to results of sensors for detecting the paper size.

Another advantage of the present invention is that it becomes easier for an operator to specify a paper size because candidates of paper sizes according to results of sensors are displayed to assist the operator when the paper size cannot be decided by sensors.

An advantage of the present invention is that it is not instructed to specify a paper size for an image forming apparatus having a paper supplier for manual insertion, in situations when paper size is not needed to specify.

BRIEF DESCRIPTION OF THE DRAWINGS

These and other objects and features of the present invention will become clear from the following description taken in conjunction with the preferred embodiments thereof with reference to the accompanying drawings, and in which:

FIG. 14 is a plan view of a first example of a size select picture in a touch display panel;

FIG. 15 is a plan view of a second example of a size select picture in a touch display panel;

FIG. 16A is a plan view of a first example of an all size select picture displayed in a touch panel, and FIG. 16B is a plan view of a paper select picture displayed in the otuch panel; and FIG. 17 is a plan view of a second example of a paper select picture in the touch panel.

DETAILED DESCRIPTION OF THE PREFERRED EMBODIMENTS

Figure 1:
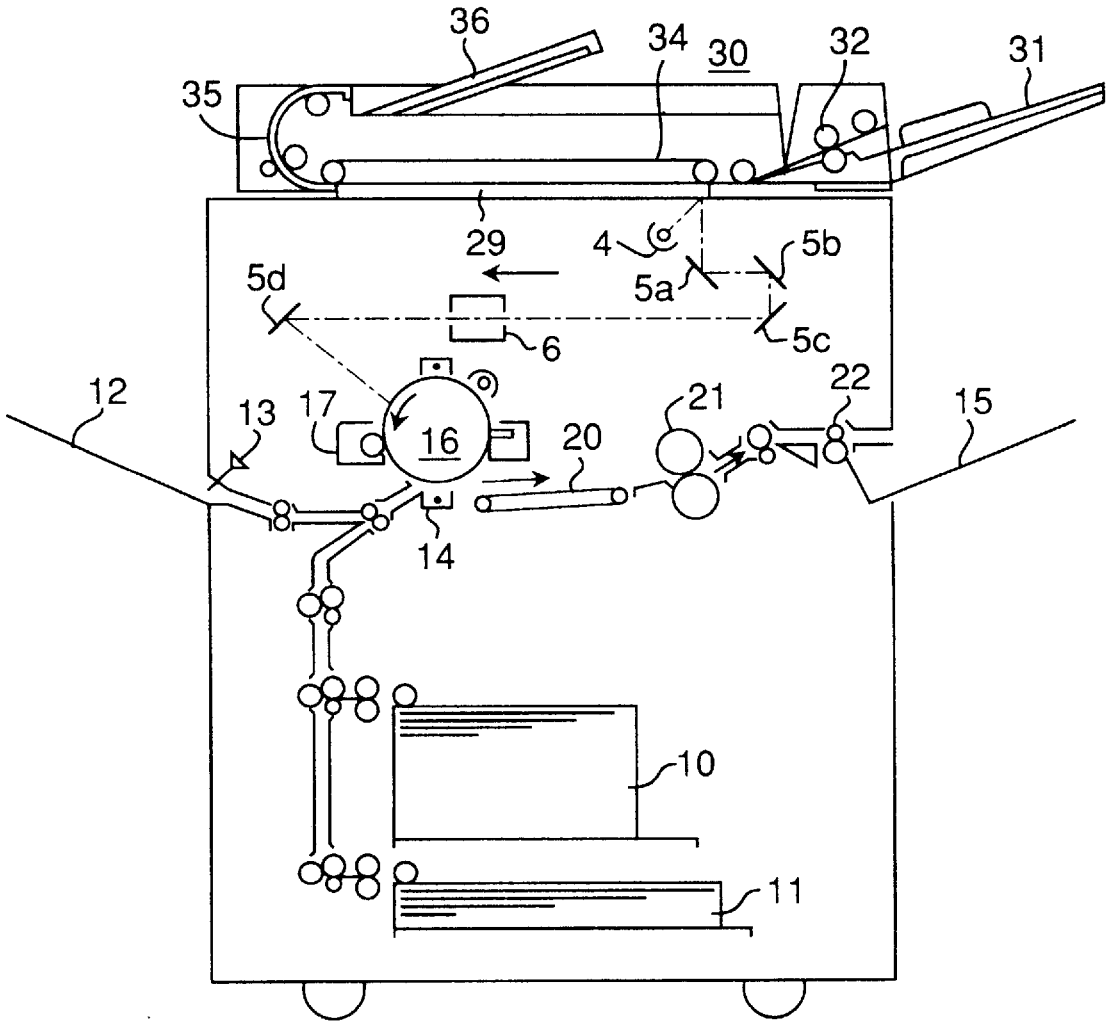
FIG. 1 is a schematic sectional view of a copying machine.

Referring now to the drawings, wherein like reference characters designate like or corresponding parts throughout the views, FIG. 1 shows a copying machine of an embodiment of the invention. A document put on a document tray 31 of a document feeder 30 is carried to a predetermined position on a platen glass 29 by rollers 32 and 34. After image data thereof is read, the document is carried onto a discharge tray 36.

The document on the platen glass 29 is exposed by a lamp 4. A light reflected from the document propagates via mirrors 5*a*, 5*b*, 5*c* and 5*d* and an optical system 6 onto a photoconductor drum 16. The lamp 4 and the mirror 5*a* are moved at a speed "V" along the subscan direction shown with an arrow in FIG. 1 to scan the whole document, and the mirrors 5*b* and 5*c* are moved at a speed of "V/2" in the same direction. Then, an electrostatic latent image of the document is formed on the photoconductor drum 16, and it is developed with toners by a developing unit 17. A sheet of paper is supplied from a cassette 10 or 11, but it may also be supplied from an insertion passage 13 when it is put on a tray 12 for manual insertion. A plurality of sheets of paper can be put on the tray 12. The toner image on the photoconductor drum 16 is transferred onto the paper by a transfer charger 14. Then, the paper is carried by a belt 20 to fixing rollers 21 to fix the toner image on the paper. Finally, it is carried out onto a tray 15.

Figure 2:
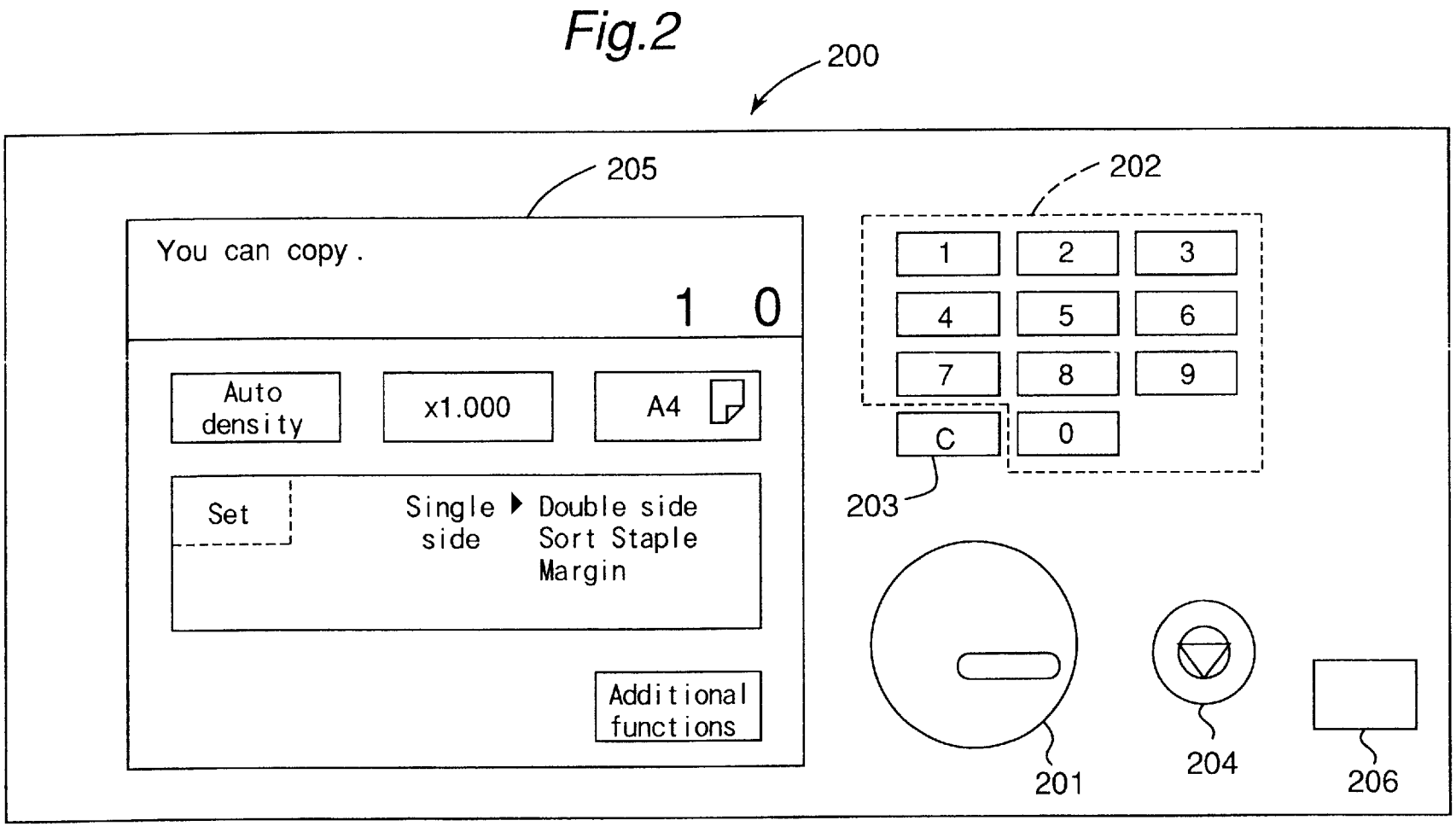
FIG. 2 is a plan view of an operational panel.

FIG. 2 shows an operational panel 200 of the copying machine. Start key 201 is provided to start copy operation. Ten-keys 202 are provided to input a number of copies or the like. Clear key 203 is provided to clear an input by the ten-keys 202. Stop key 204 is provided to stop copy operation. A display panel 205 is a liquid crystal touch panel, and it is used to display copy situation and to set various modes with direct touch by an operator. Reset key 206 is provided to initialize the mode.

Figure 3:
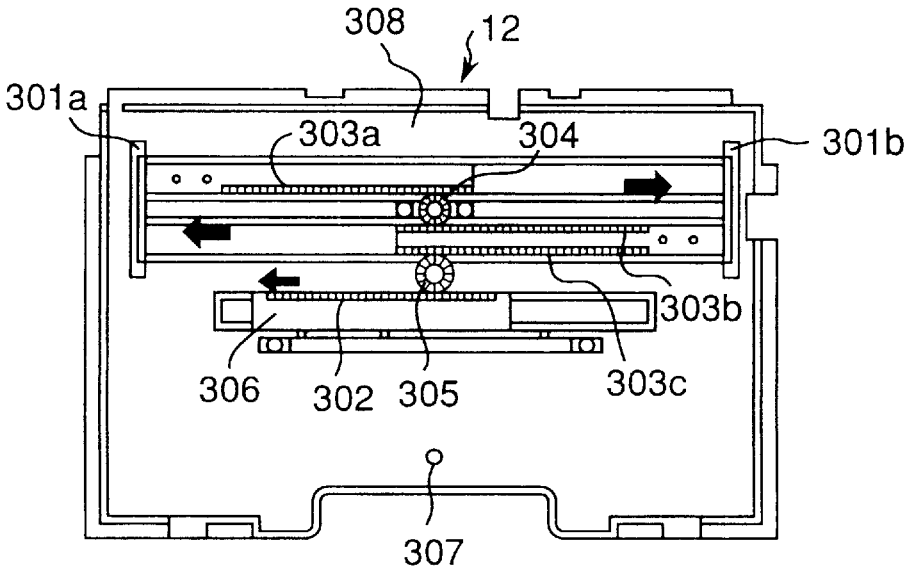
FIG. 3 is a top plan view of a mechanism of a tray for detecting the paper size of a paper inserted onto the tray.
Figure 4:
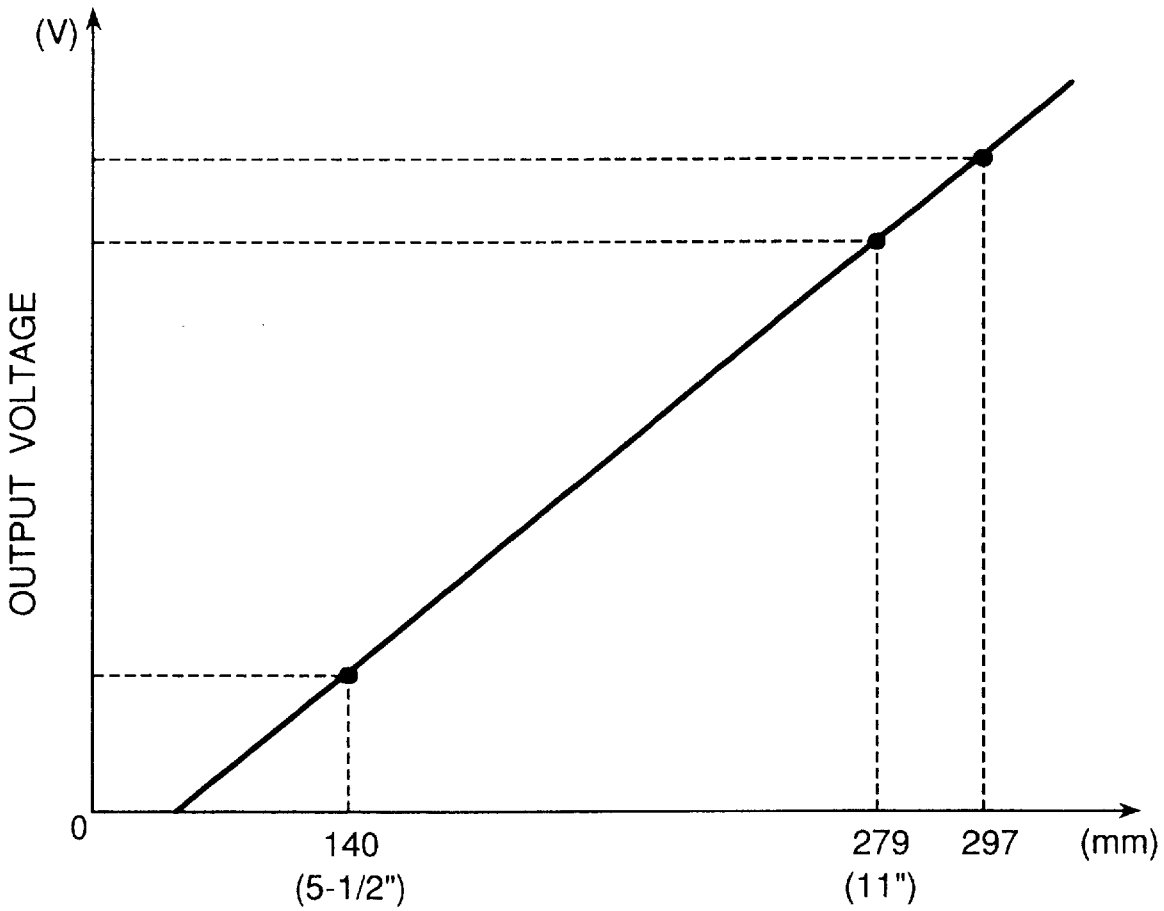
FIG. 4 is a graph of the sensor output plotted against paper size.

FIG. 3 is a top plan view of the tray 12 for supplying a sheet of paper to the insertion passage 13 for detecting the paper size of a paper inserted onto the tray 12. When a sheet of paper is put on the tray 12, the side plates 301*a* and 301*b* are fitted to the width of the paper or a length thereof along a direction perpendicular to the paper supply direction. The side plates 301*a* and 301*b* have rack gears 303*a* and 303*b* which are connected to each other via a pinion gear 304. When one of the side plates 301*a* and 301*b* is moved, the other is also moved through the pinion gear 304, as shown by two arrows of opposite directions. An electrical resistor (sliding resistor) 306 is set to change the resistance thereof according to the movement, and it has a rack gear 302 which is connected via another pinion gear 305 to another rack gear 303*c* of the side plate 301*b*. Thus, the resistance of the resistor 306 is changed according to the movement of the side plates 301*a* and 301*b*. As shown in FIG. 4, the resistance of the resistor 306 is converted to an electrical voltage, and the width of the paper is detected on the basis of the voltage. Further, a sensor 308 is provided for detecting the existence of a paper on the tray 12.

A sensor 307 is provided to detect a length of the paper along the paper supply direction. Then, it is detected if the sheet of paper is longer along the paper supply direction or along the direction perpendicular thereto. In this embodiment, the sensor 307 is at a position about 230 mm from the top of the paper put on the tray 12. By using the two sensing means, that is, the resistor 306 and the sensor 307, the paper size can be decided.

Table 1 shows the width obtained from the voltage converted from the resistance and the paper size determined by the width and the turning on/off of the sensor 307. In Table 1, "T" denotes a sheet of paper longer in the paper supply direction, while "Y" denotes a sheet of paper long in the direction perpendicular thereto. For example, if the detected width of the paper is 182 mm and the sensor 307 is turned off when the paper is put on the tray 12, the paper size is determined to be B5T.

TABLE 1

| | Paper sizes derived from signals | | | | | | | |
|---|---|---|---|---|---|---|---|---|
| Width | 140 | 148 | 182 | 210 | 216 | 257 | 280 | 297 |
| ON (sensor) | 5.5*8.5T | A5T | — | — | — | B5Y | 8.5*11Y | A4Y |
| OFF (sensor) | — | — | B5T | A4T | 8.5*11T | B4T | 11*14 | A3T |
| | — | — | — | FLS | 8.5*14T | — | 11*15 | — |
| | — | — | — | — | — | — | 11*17 | — |

NB: The width is written in the unit of mm. "T" denotes a paper longer in the papr supply direction, while "Y" denotes a paper longer in the direction perpendicular thereto. "FLS" denotes foolscap.

Figure 5:
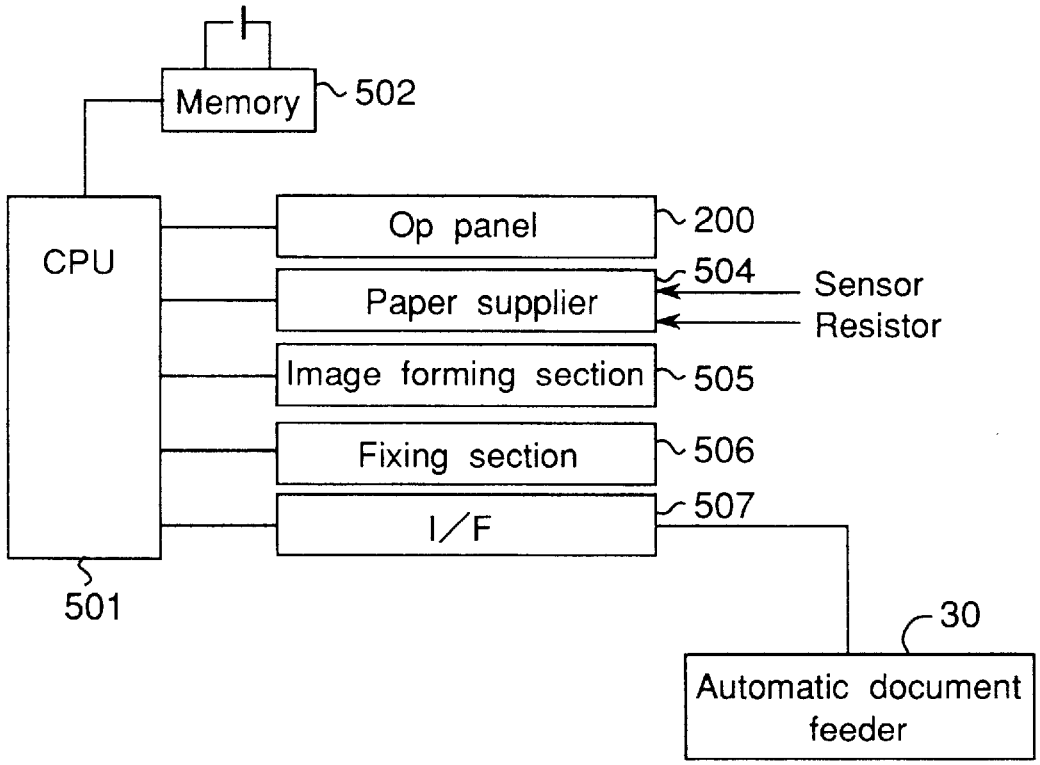
FIG. 5 is a block diagram of a controller of the copying machine.

FIG. 5 shows a block diagram of a control block of the copying machine. A central processing unit (CPU) 501 in the control block controls copy operation of the copying machine, and it is connected to a memory 502 with a cell for backup. Further it is connected to the operational panel 200, a paper supplier system 504 for controlling rollers and the like for the cassettes 10, 11 and the tray 12 for manual insertion, the image forming section 505 for controlling the photoconductor drum 14, the developing unit 17, a fixing unit 506 for controlling the fixing rollers 21, and an interface 507 with the automatic document feeder 30. The paper supplier 504 receives signals from the resistor 306 and the sensor 307 in the tray 12, and it decides the paper size according to the voltage from the resistor 306 and the output signal of the sensor 307.

Figure 6:
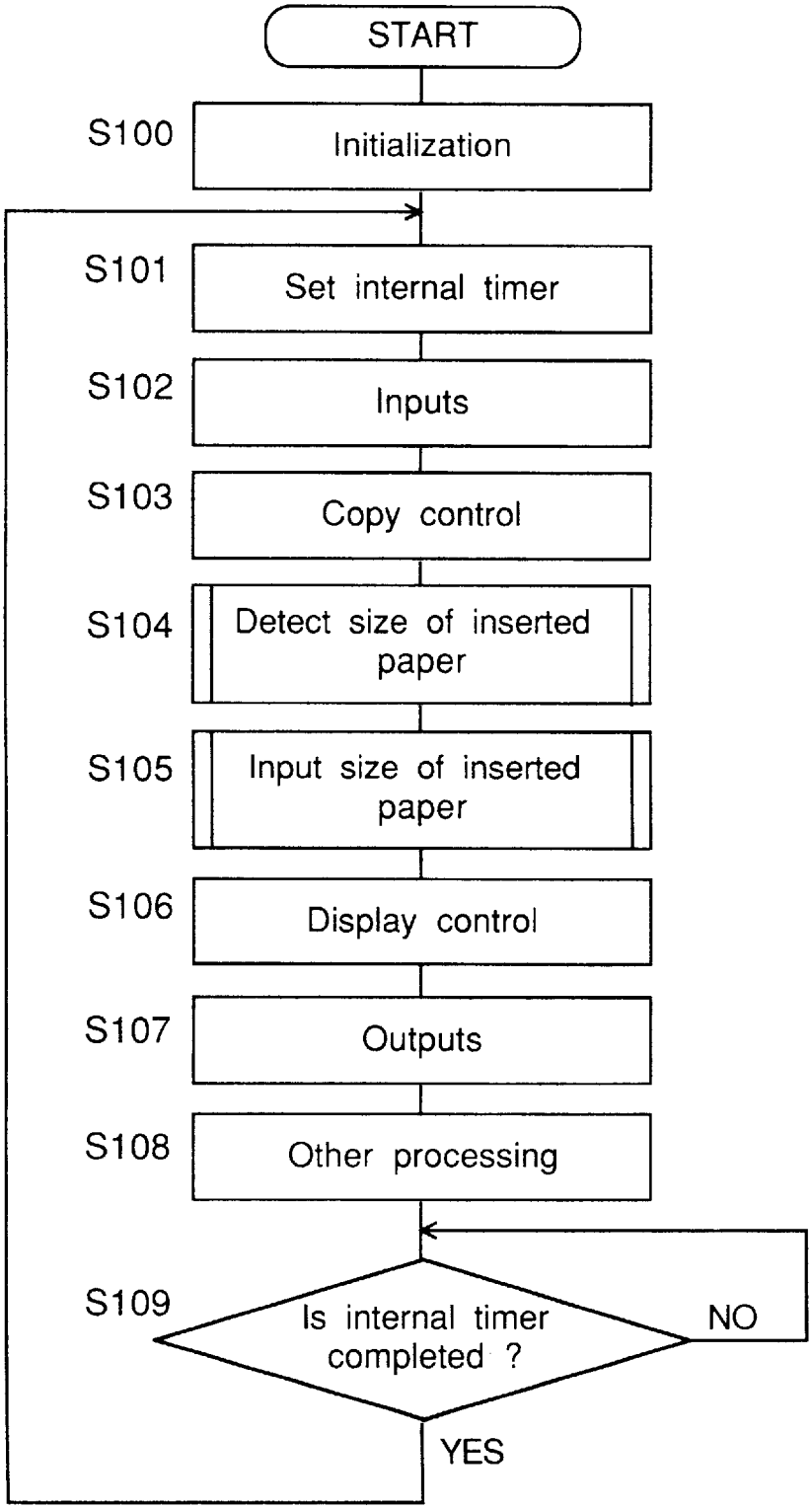
FIG. 6 is a flowchart of the controller.

FIGS. 6–13 show flowcharts for the copy operation in various examples. FIG. 6 shows a main routine executed by the central processing unit 501. When the main routine is started, data in an internal memory and registers are reset, and an internal timer is also reset for initialization (step S100). Then, the internal timer is started (step S101). Next, various inputs are received from switches and sensors provided to control the copying machine (step S102), and copying conditions are controlled (step S103). When a paper is set in the tray 12, the paper size of a sheet of paper supplied from the tray 12 is detected (step S104), and the paper size of the inserted paper is input (step S105). Further, the operational panel 200 is controlled for display and the like (step S106), and signals for motors and solenoids for the image forming section 505 are output (step S107). Then, other processing is performed (step S108), and after the internal timer is completed (YES at step S109), the flow returns to step S101.

Figure 7:
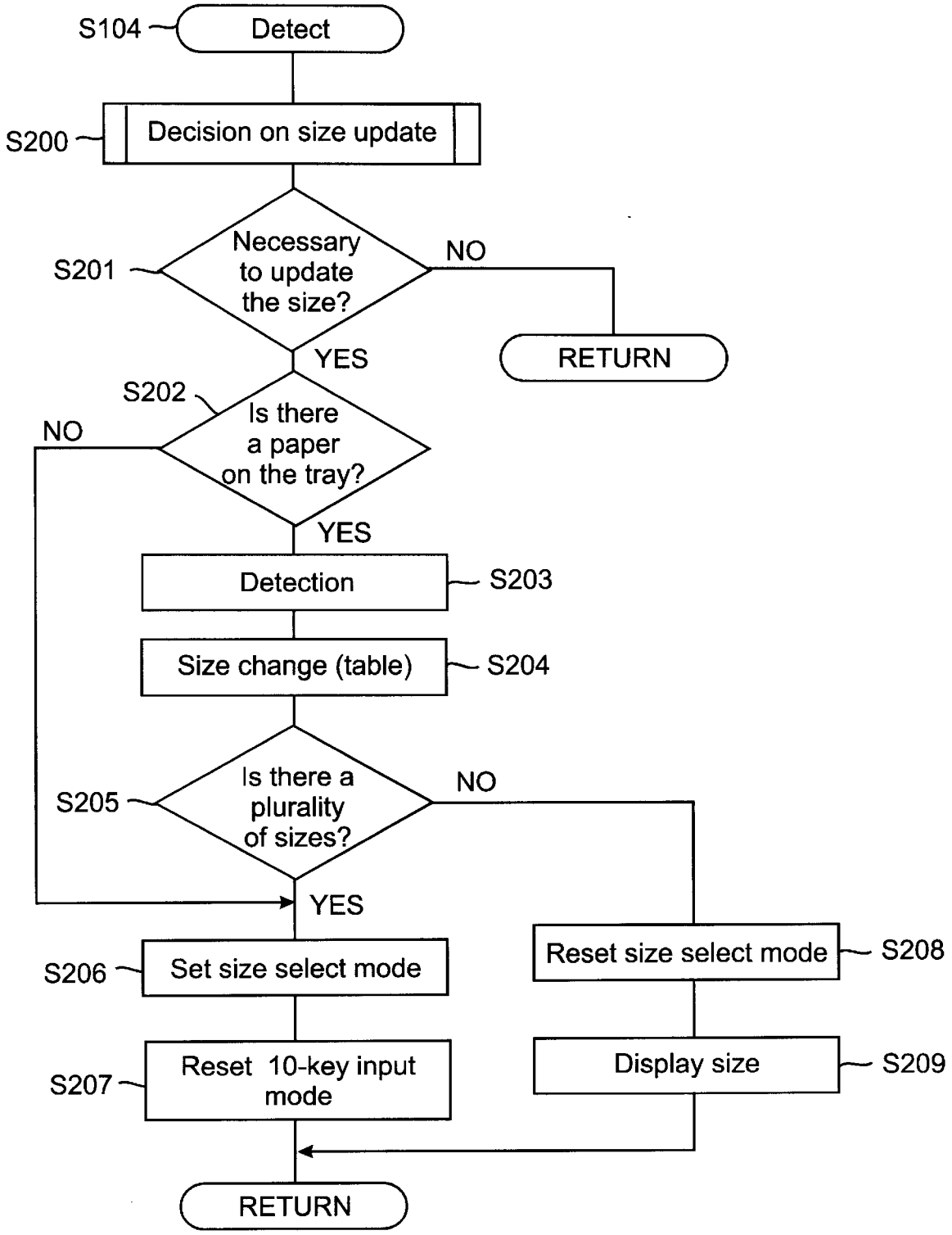
FIG. 7 is a flowchart of decision on paper size on a tray.

FIG. 7 shows a flow on an example of the detection of paper size for the tray 12 for manual insertion (FIG. 6, step S104). First, it is decided if it is necessary to update the paper size for the tray 12 (step S200, refer to FIGS. 8–12). If the paper size is decided not to be needed to be updated (NO at step S201), the flow returns readily. As explained later, in situations where paper size will not be changed, it is decided that paper size is not needed to be updated. For example, when copying is interrupted during a continuous copying, paper size has to be kept the same, and the paper size has to be kept the same after restarting the copying operation.

If the paper size is decided to be needed to be updated (YES at step S201), it is decided next if there is a paper on the tray 12 (step S202). If it is decided that there is no paper on the tray 12 (NO at step S202), the flow proceeds to step S206. On the other hand, if it is decided that there is a paper on the tray 12 (YES at step S202), the voltage from the resistor 306 and the output signal of the sensor 307 are received (step S203), and paper size is determined according to Table 1 explained above (step S204). However, if the paper size cannot be determined uniquely and there is a plurality of paper sizes derived from the signals from the resistor 306 and the sensor 307 (YES at step S205), size select mode is set for specifying paper size by operaoperator by using a display in the operational panel 200 (step S206), and ten-key input mode for inputting numerical values of paper size is reset (step S207). Thus, an operator can specify the paper size when a unique paper size cannot be determined on the signals received from the resistor 306 and the sensor 307. As explained later, a picture for assisting selection of paper size is displayed in the display panel 205. On the other hand, if paper size is specified according to the input signals (NO at step S205), the size select mode is reset (step S208), and the paper size is displayed in the display panel 205 (step S209).

Figure 8:
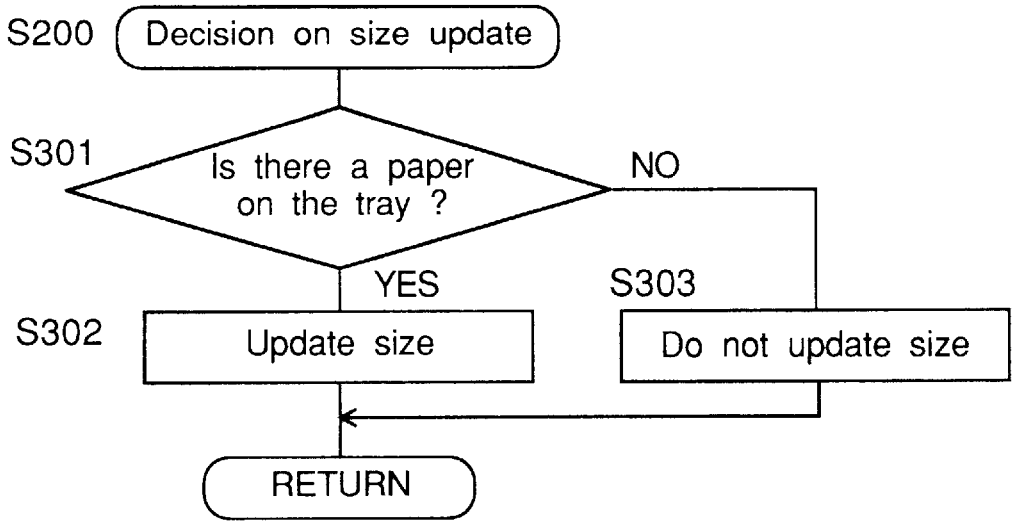
FIG. 8 is a flowchart of a first example of decision on size update.

FIGS. 8–12 show various examples of processings for the decision of step S200 in FIG. 7 to determine if it is necessary to update the paper size for the tray 12 or not. FIG. 8 shows a first example of the decision on size update (FIG. 7, step S200). If it is decided that a paper is put on the tray (YES at step S301), it is decided that the paper size is necessary to be updated (step S302). Otherwise it is not decided that the paper size is necessary to be updated (step S303). This processing takes into account that a paper put on the tray 12 has a various size. Then, when a paper is put on the tray 12, it is requested for an operator to specify the paper size thereof.

Figure 9:
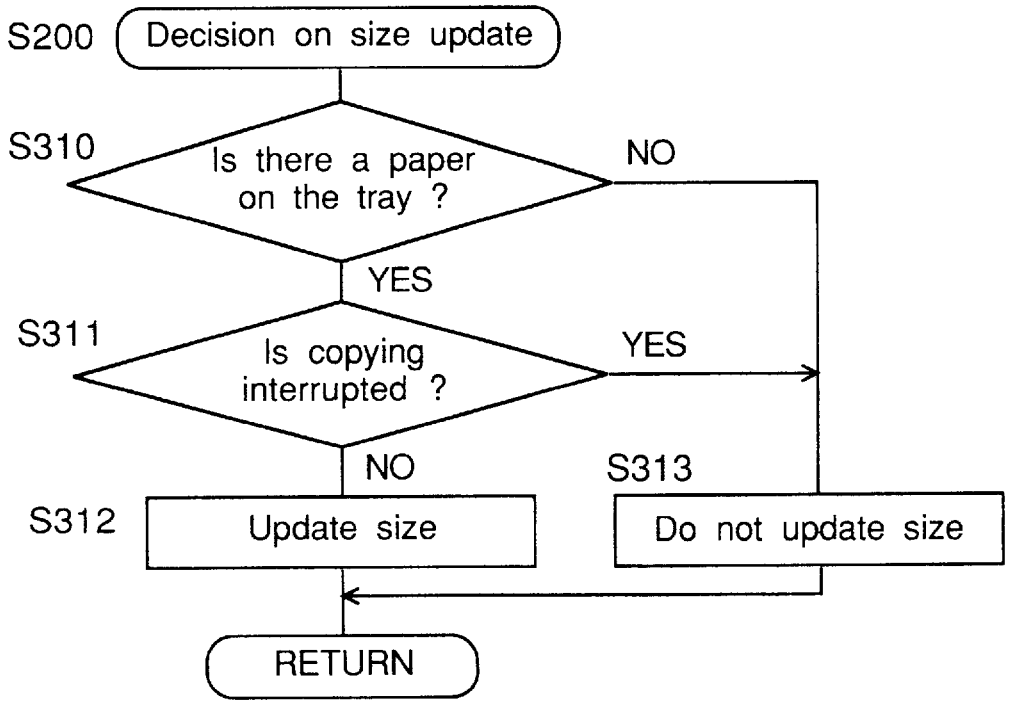
FIG. 9 is a flowchart of a second example of decision on size update.

FIG. 9 shows a second example of the decision on size update (FIG. 7, step S200). If it is decided that a paper is put on the tray (YES at step S310), and if it is not decided that copying is interrupted (NO at step S311), it is decided that the paper size is necessary to be updated (step S312). Otherwise it is not decided that the paper size is necessary to be updated (step S313). This processing takes interruption into account besides the existence of a paper on the tray 12. Interruption occurs for example when paper empty happens in a continuous copying, or when papers are extracted for solving a jam. When a paper is not put on the tray 12, and copying is interrupted, copying will be continued by the same paper cassette 10 or 12 with the same paper size. Then, the paper size is not requested to be updated in this situation.

Figure 10:
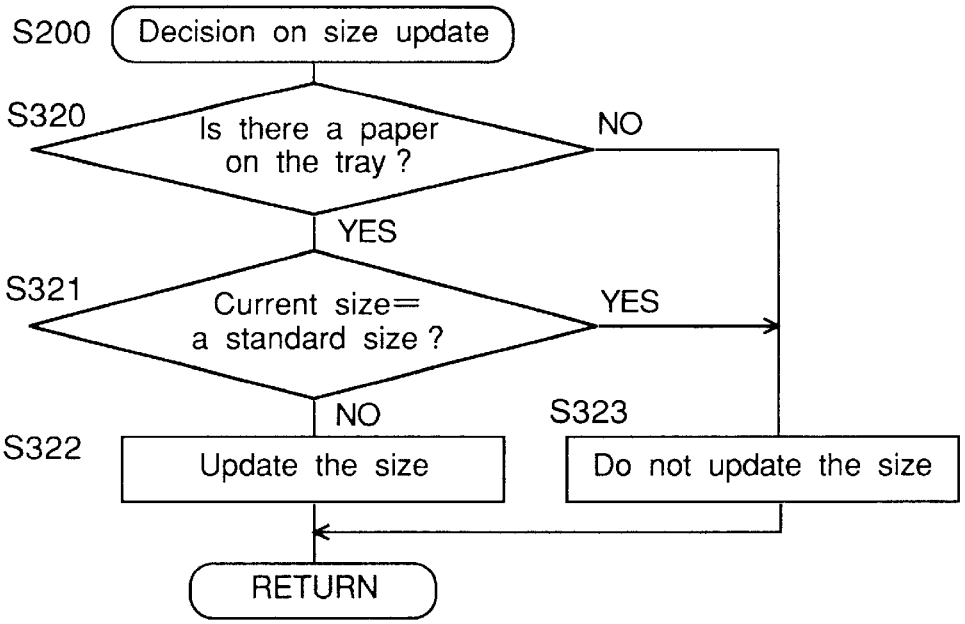
FIG. 10 is a flowchart of a third example of decision on size update.

FIG. 10 is a third example of the decision on size update (FIG. 7, step S200). If it is decided that a paper is put on the tray (YES at step S320), and if it is not decided that the current paper size is a standard paper size (NO at step S321), it is decided that the paper size is necessary to be updated (step S322). Otherwise it is not decided that the paper size is necessary to be updated (step S323). This processing takes into account whether the current paper size before using the tray 12 is a standard size or not. When a paper is put on the tray 12 and the current paper size is not a standard paper size, a paper of irregular size may be put on the tray 12. For example, when papers of an irregular size cannot be supplied on the tray 12 continuously, a paper of the irregular size is put on the tray one by one. Then, it is desirable that the paper size is not requested to be updated in this situation.

Figure 11:
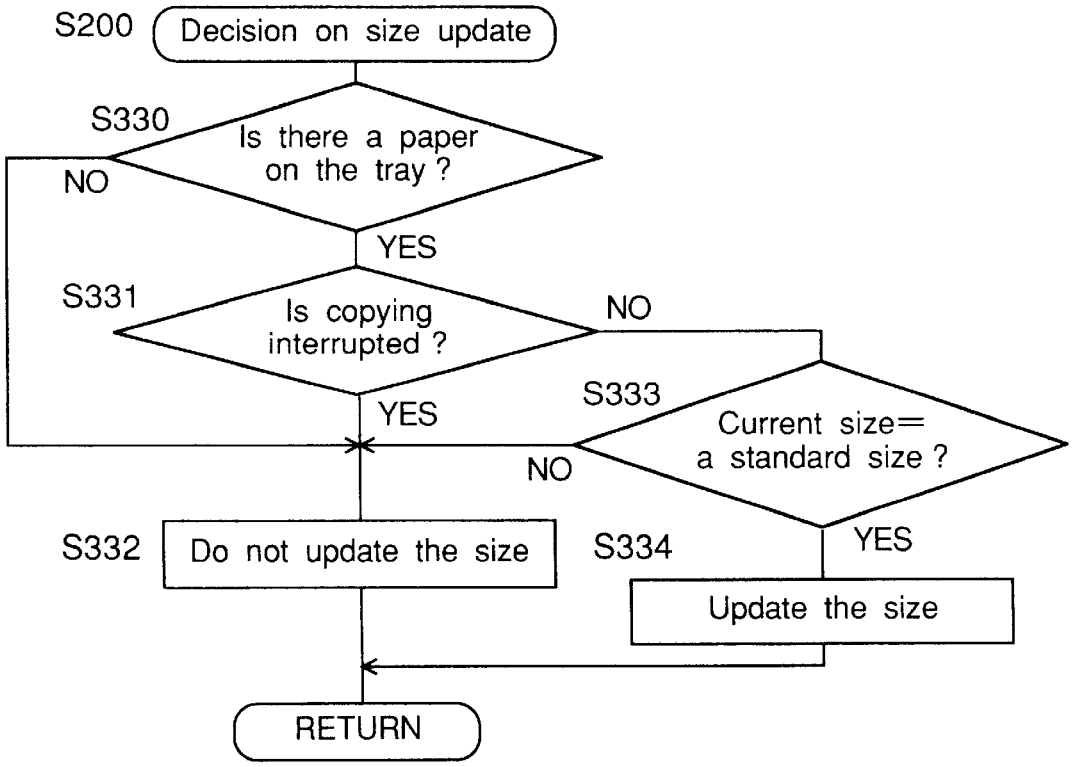
FIG. 11 is a flowchart of a fourth example of decision on size update.

FIG. 11 shows a fourth example of the decision on size update (FIG. 7, step S200). If it is decided that a paper is put on the tray (YES at step S330), and if it is decided that copying is interrupted (YES at step S331), it is decided that the paper size is not necessary to be updated (step S332). If it is decided that a paper is not put on the tray (NO at step S330), it is also decided that the paper size is not necessary to be updated (step S332). If it is decided that a paper is put on the tray (YES at step S330), and if it is decided that copying is not interrupted (NO at step S331), and if it is decided next that the current paper size is not a standard size (NO at step S333), it is also decided that the paper size is not necessary to be updated (step S332). On the other hand, if it is decided that the current paper size is a standard size (YES step S333), it is decided that the paper size is necessary to be updated (step S334). This processing takes into account whether the current paper size before using the tray 12 is a standard size or not, besides interruption. When there is no paper on the tray 12, paper size is not requested to be updated as in the above examples. Further, when a paper is put on the tray 12 and copying is interrupted, the paper size is not requested to be updated. However, when the current paper size is an irregular size, the paper size is not requested to be updated, as in the example shown in FIG. 11.

Figure 12:
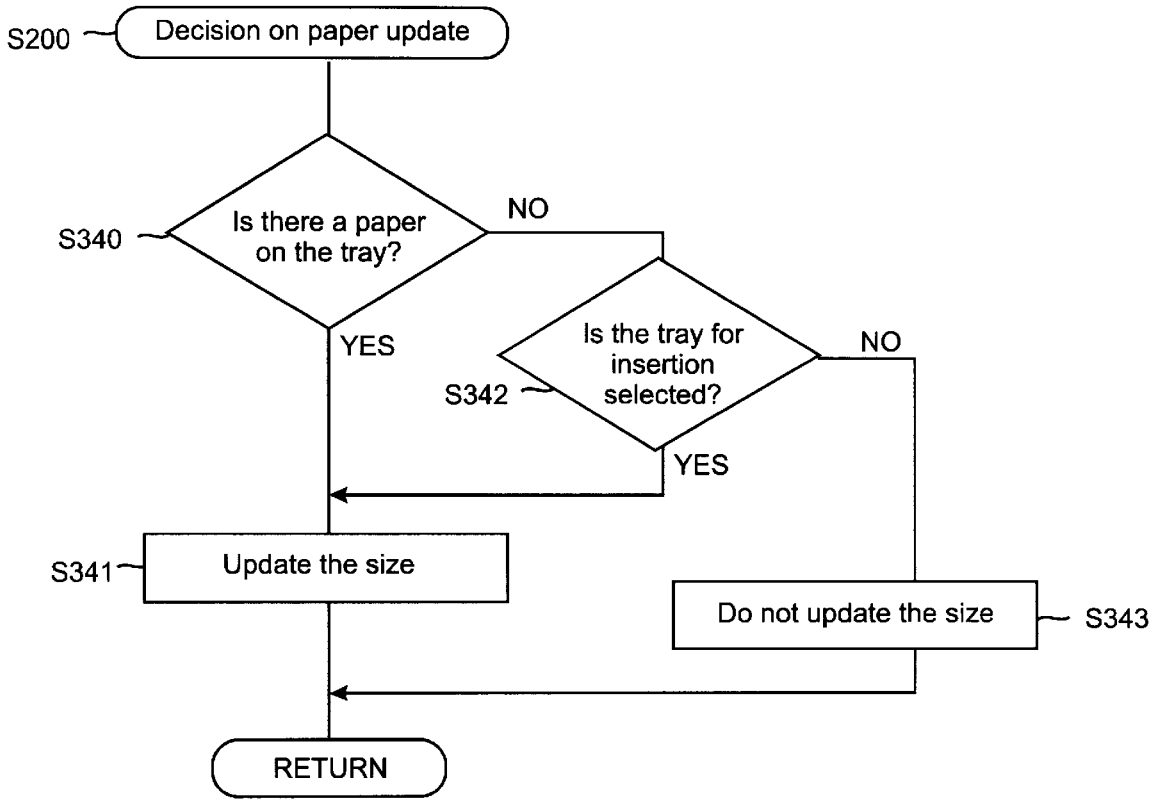
FIG. 12 is a flowchart of a fifth example of decision on size update.

FIG. 12 shows a fifth example of the decision on size update (FIG. 7, step S200). If it is decided that a paper is put on the tray (YES at step S340), it is decided that the paper size is necessary to be updated (step S341). If it is not decided that a paper is put on the tray (NO at step S340), and if it is decided that the tray 12 for manual insertion is selected (YES at step S342), it is also decided that the paper size is necessary to be updated (step S341). If it is decided that the tray 12 for manual insertion is not selected (YES at step S342), it is not decided that the paper size is necessary to be updated (step S343). When a paper is not inserted on the tray 12, copying will be continued by the same paper cassette 10 or 12 with the same paper size. Then, the paper size is not requested to be updated in this situation.

Next, the input of the paper size of a paper inserted on the tray 12 (FIG. 6, step S105) is explained. Papers used for reproducing a document image usually has standards sizes such as A4 and letter, and even if the number of sensors in the tray 12 is small, many paper sizes can be determined according to the signals from the sensors. For example, as shown in Table 1, paper sizes of 5.5*8.5T, A5T, B5Y and B4T can be determined. However, the sensors mounted in the tray 12 cannot determine the paper size correctly, for example, among standard paper sizes having the same width and different lengths, though the tray 12 has the mechanism for detecting paper size. In this case, the paper size is required to be specified by an operator. It is desirable to assist an operator so that the paper size can be specified easily. Further, the complexity of the specification procedure depends on the type of paper size of a standard size or an irregular size. Then, the flow shown in FIG. 13 takes these points into account.

Figure 13:
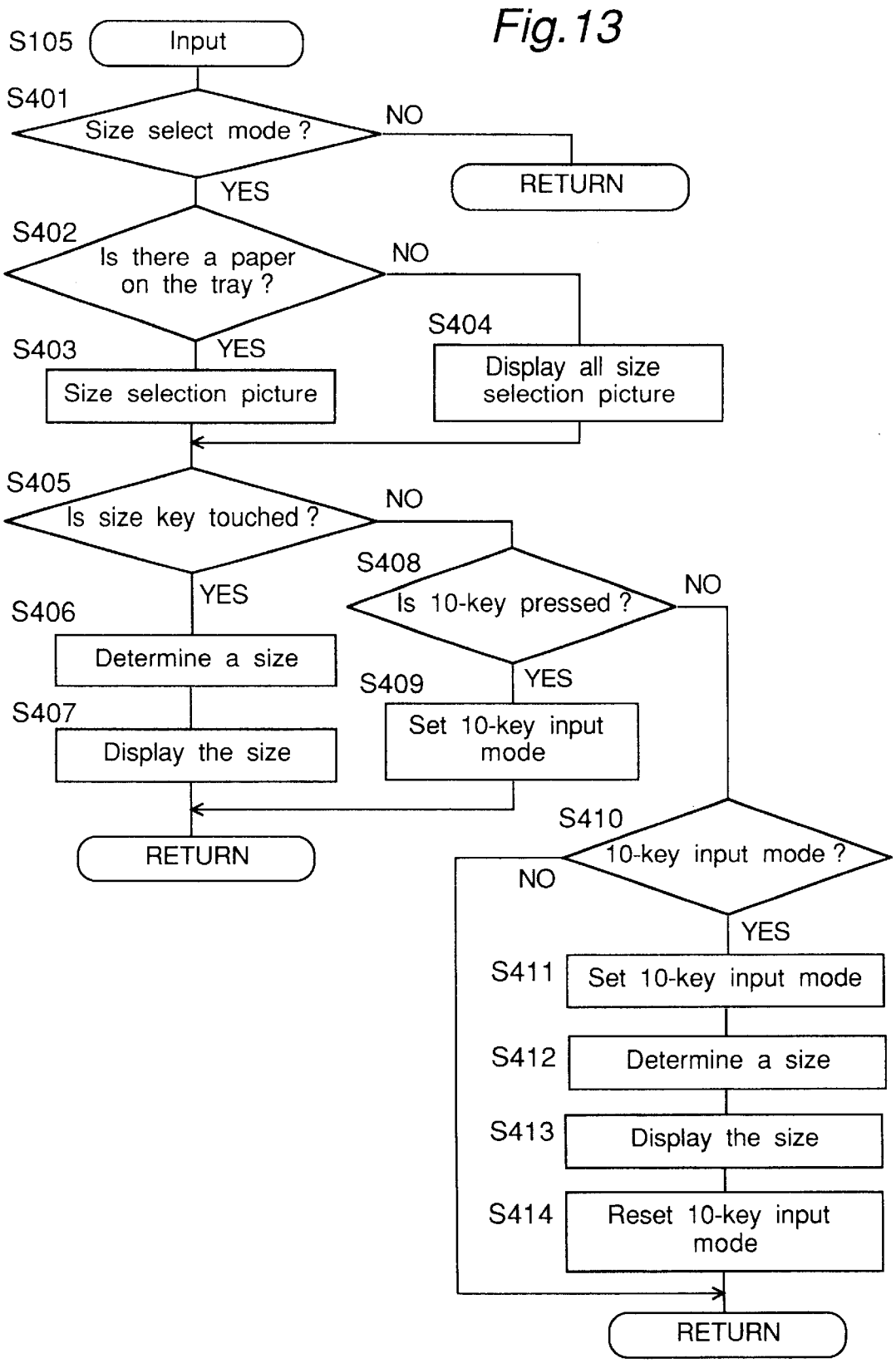
FIG. 13 is a flowchart for inputting the size of an inserted paper.

FIG. 13 is a flowchart for inputting the paper size of a paper inserted on the tray 12 (FIG. 6, step S105). It is decided first if the size select mode is set in the step S206 in FIG. 7 on the detection of paper size on the tray or not (step S401). The size select mode is set, for example, when there is found a plurality of paper sizes on the basis of the signals from the sensors. If the size select mode is decided not to be set (NO at step S401), the flow returns. On the other hand, if the size select mode is decided to be set (YES at step S401), it is decided next if there is a paper on the tray 12 or not (step S402). If it is decided that there is a paper on the tray 12 (YES at step S402), a size select picture, as shown in FIG. 14, is displayed on the display panel 205 (step S403).

Table 2 shows paper sizes which can be selected according to the detected width of the paper. Paper sizes shown in the right column in Table 2 is displayed in the touch panel 205 according to the signals. For example, if the resistor 306 detects a document of size 11*14 of the width of 11 inches and the sensor 306 detects the existence of the paper, a paper size among paper sizes of 11*14, 11*15 and 11*17 is selected. Then, as shown in FIG. 14, the size select picture displayed on the touch panel 205 at step S403 shows the paper sizes of 11*14, 11*15 and 11*17. Then, an operator selects a paper size among the displayed candidates for selection.

TABLE 2

Paper sizes to be displayed

| Paper size | Sizes displayed for selection |
|---|---|
| A4T | A4T, FLS |
| FLS | A4T, FLS |
| 8.5*11T | 8.5*11T, 8.5*14T |
| 8.5*14T | 8.5*11T, 8.5*14T |
| 11*14 | 11*14, 11*15, 11*17 |
| 11*15 | 11*14, 11*15, 11*17 |
| 11*17 | 11*14, 11*15, 11*17 |

If detection precision of the width with the side plates 301*a* and 301*b* is not so high, for example, vertical widths 210 mm of A4 size and 216 mm (=8.5 inches) of letter size cannot be discriminated. In such a case, all sizes near the detected vertical width within a difference of, for example, ±10 mm may be displayed for assisting selection of paper size. Table 3 shows an example of a table used for this case. The paper sizes shown in the right column are displayed according to the detected paper size shown in the left column. For example, if a paper size near A4T is detected for a document of size A4T (or if the detected size is within ±10 mm from the vertical length of A4T), paper sizes of A4T, 8.5*11T, 8.5*14T and foolscap (FLS) are displayed as shown in FIG. 15.

TABLE 3

Paper sizes to be displayed

| Detected size | Sizes displayed for selection |
|---|---|
| A4T | A4T, 8.5*11T, FLS, 8.5*14T |
| 8.5*11T | A4T, 8.5*11T, FLS, 8.5*14T |
| FLS | A4T, 8.5*11T, FLS, 8.5*14T |
| 8.5*14T | A4T, 8.5*11T, FLS, 8.5*14T |
| 11*14 | 11*14, 11*15, 11*17 |
| 11*15 | 11*14, 11*15, 11*17 |
| 11*17 | 11*14, 11*15, 11*17 |

Returning to FIG. 13, if it is not decided that there is a paper on the tray 12 (NO at step S402), an all size select picture as shown in FIG. 16A is displayed on the touch panel 205 (step S404). That is, all the paper sizes are displayed on the touch panel 205. This happens, for example, when "TRAY FOR INSERTION" is touched in a picture for paper select in the touch panel 205, as shown in FIG. 16B, before a paper is put on the tray 12.

After the picture is displayed, it is waited that one of the paper size keys on the touch panel 205 is touched (step S405). If one of them is decided to be touched (YES at step S405), the paper size on the tray 12 is determined (step S406), and it is displayed on the display panel 205 (step S407). On the other hand, if "10-key input" shown in FIG. 16A is decided to be touched (YES at step S408), 10-key input mode is set for inputting a paper size with 10-keys (step S409). If "10-key input" is decided not to be touched (NO at step S408), but if "10-key input model" has already been set (YES at step S410), a paper size is input with 10-keys by an operator (step S411). Then, the paper size on the tray 12 is determined (step S412), the determined size (A4T in this case) is displayed on the touch panel 205, as shown in FIG. 17 (step S413), and the 10-key input mode is reset (step S414).

In the embodiment explained above, the tray 12 for manual insertion has a mechanism for paper size detection. However, if the tray 12 does not have such a mechanism, steps S202–S205 are deleted in the flow shown in FIG. 7. Further, if the paper size is decided to be needed to be updated (YES at step S201), the flow proceeds to step S206 for the size select mode, otherwise the flow proceeds to step S207 to reset the size select mode.

As explained above, the size of a paper put in the tray 12 for manual insertion is decided according to sensors 306 and 307 provided in the tray 12. Only when detection precision of the paper size is not so high to determine a paper size, a paper size selection picture for assisting selection is displayed as shown in FIG. 14, 15 or 16A, and an operator can specify a paper size surely by referring to the touch panel 205. Thus, paper size for the tray 12 can be specified, and erroneous copying can be prevented.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus comprising:

a paper supplier for inserting a sheet of paper;

a detector for detecting at least a length of one side of the paper supplied to said paper supplier;

a specifying means for specifying a paper size according to signals received from said detector;

an input device for inputting a size of the paper manually when said specifying means fails to specify the paper size; and an image forming means for forming an image on the paper.

2. The image forming apparatus according to claim 1, wherein said paper supplier comprises a guide member for guiding the paper, the guide member being moved in a direction perpendicular to a paper supply direction, and said detector comprises a first sensor to detect a width along the direction perpendicular to the paper supply direction according to a position of said guide member.

3. The image forming apparatus according to claim 2, wherein said detector further comprises a second sensor for detecting whether a length along the paper supply direction is longer than a predetermined length or not.

4. The image forming apparatus according to claim 1, wherein said specifying means comprises a liquid crystal panel which displays a plurality of paper sizes derived from signals received from said detector.

5. A method for specifying a paper size in an image forming apparatus, comprising the steps of:

inserting a sheet of paper on a paper supplier of the image forming apparatus;

detecting at least a length of one side of the paper;

specifying a paper size according to at least the length of one side of the paper;

inputting a size of the paper manually when specification of the paper size is failed; and forming an image on the paper.

6. An image forming apparatus comprising:

a paper supplier for inserting a paper;

a detector for detecting at least a length of one side of a sheet of paper supplied to said paper supplier;

a display device for displaying a plurality of paper sizes having a side equal to the length detected by said detector; and an image forming means for forming an image on the paper.

7. The image forming apparatus according to claim 6, wherein said paper supplier comprises a guide member for guiding the paper, the guide member being moved in a direction perpendicular to a paper supply direction, and said detector comprises a first sensor to detect a width along the direction perpendicular to the paper supply direction according to a position of said guide member.

8. The image forming apparatus according to claim 7, wherein said detector further comprises a second sensor for detecting whether a length along the paper supply direction is longer than a predetermined length or not.

9. The image forming apparatus according to claim 6, wherein said specifying means comprises a liquid crystal panel which displays a plurality of paper sizes derived from signals received from said detector and determines a paper size when one of the plurality of paper sizes displayed is specified.

10. A method for specifying a paper size in an image forming apparatus, comprising the steps of:

inserting a sheet of paper on a paper supplier of the image forming apparatus;

detecting at least a length of one side of the paper;

displaying a plurality of paper sizes having a side equal to the detected length; and forming an image on the paper.

11. An image forming apparatus comprising:

a paper supplier for inserting a paper;

a detector for detecting at least a length of one side of a sheet of paper supplied to said paper supplier;

a display device for displaying a plurality of paper sizes having a side having a length within a predetermined range including the length detected by said detector; and an image forming means for forming an image on the paper.

12. The image forming apparatus according to claim 11, wherein said paper supplier comprises a guide member for guiding the paper, the guide member being moved in a direction perpendicular to a paper supply direction, and said detector comprises a first sensor to detect a width along the direction perpendicular to the paper supply direction according to a position of said guide member.

13. The image forming apparatus according to claim 12, wherein said detector further comprises a second sensor for detecting whether a length along the paper supply direction is longer than a predetermined length or not.

14. The image forming apparatus according to claim 11, wherein said specifying means comprises a liquid crystal panel which displays a plurality of paper sizes derived from signals received from said detector and determines a paper size when one of the plurality of paper sizes displayed is specified.

15. An image forming apparatus comprising:

a paper supplier for inserting a paper;

a first detector for detecting a length of at least one side of a sheet of paper supplied to said paper supplier;

a second detector for detecting whether a sheet of paper is put in said paper supplier;

a first instruction means for instructing paper supply by said paper supplier;

a second instruction means for inputting a paper size manually when said second detector does not detect a paper in said paper supplier and said first instruction means instructs paper supply by said paper supplier; and an image forming means for forming an image on the paper.

16. The image forming apparatus according to claim 15, wherein said paper supplier comprises a guide member for guiding the paper, the guide member being moved in a direction perpendicular to a paper supply direction, and said second detector comprises a sensor to detect a width along the direction perpendicular to the paper supply direction according to a position of said guide member.

17. The image forming apparatus according to claim 15, wherein said second instruction means comprises a liquid crystal panel which displays a plurality of paper sizes derived from signals received from said detector and determines a paper size when one of the plurality of paper sizes displayed is specified.

18. An image forming apparatus comprising:

an image forming means for forming an image on a sheet of paper;

a first detector for detecting whether image forming by said image forming means is interrupted or not;

a paper supplier for putting a plurality of sheets of paper and for supplying them continuously;

a second detector for detecting whether a sheet of paper is put in said paper supplier; and a means for instructing input of a paper size manually if interrupt of image forming is not detected by said first detector and for keeping a current paper size set before interrupt of image forming if the interrupt is detected, when said second detector detects a sheet of paper put in said paper supplier.

19. An image forming apparatus comprising:

an image forming means for forming an image on a sheet of paper;

a first detector for detecting whether image forming of said image forming means is interrupted or not;

a paper supplier for receiving a plurality of sheets of paper and for supplying the sheets of paper continuously;

a second detector for detecting at least a length of one side of a sheet of paper supplied to said paper supplier;

a specifying means for specifying a paper size according to said second detector; and a means for instructing input of a paper size manually if interrupt of image forming is not detected by said first detector and for keeping the paper size set before interrupt if interrupt of image forming of said image forming means is detected by said first detector, or when said specifying means does not specify a sheet of paper in said paper supplier.

20. The image forming apparatus according to claim 19, wherein said second detector supplier comprises a guide member set in said paper supplier, said guide member being moved in a direction perpendicular to a paper supply direction, and said detector comprises a first sensor to detect the paper size along the direction perpendicular to the paper supply direction according to a position of the guide member.

21. The image forming apparatus according to claim 19, wherein said second detector further comprises a second sensor for detecting a length of the paper to decide whether the length along the paper supply direction is longer than a predetermined length or not.

* * * * *